US007786387B2

(12) United States Patent
Pupke et al.

(10) Patent No.: US 7,786,387 B2
(45) Date of Patent: Aug. 31, 2010

(54) COMPOSITE ELECTRICAL CONDUCTOR AND METHOD FOR PRODUCING IT

(75) Inventors: Frank Pupke, Hettstedt (DE); Kurt Beyer, Mansfeld (DE)

(73) Assignee: NKT Cables GmbH, Cologone (DE)

( * ) Notice: Subject to any disclaimer, the term of this patent is extended or adjusted under 35 U.S.C. 154(b) by 112 days.

(21) Appl. No.: 12/158,406

(22) PCT Filed: Dec. 18, 2006

(86) PCT No.: PCT/EP2006/012177

§ 371 (c)(1),
(2), (4) Date: Nov. 7, 2008

(87) PCT Pub. No.: WO2007/071355

PCT Pub. Date: Jun. 28, 2007

(65) Prior Publication Data

US 2009/0075117 A1 Mar. 19, 2009

(30) Foreign Application Priority Data

Dec. 20, 2005 (DE) ..... 10 2005 060 809

(51) Int. Cl.
*H01B 5/00* (2006.01)

(52) U.S. Cl. ..... 174/126.2

(58) Field of Classification Search ..... 174/126.1, 174/126.2

See application file for complete search history.

(56) References Cited

U.S. PATENT DOCUMENTS

| | | | | |
|---|---|---|---|---|
| 6,518,505 | B1 * | 2/2003 | Matsui et al. | 174/126.1 |
| 7,560,649 | B2 * | 7/2009 | Takahashi et al. | 174/126.1 |
| 2003/0089518 | A1 | 5/2003 | Matsui et al. | |
| 2005/0178000 | A1 | 8/2005 | McCullough et al. | |

FOREIGN PATENT DOCUMENTS

| | | |
|---|---|---|
| DE | 221169 | 4/1910 |
| DE | 19539174 | 2/1997 |
| EP | 0125788 | 11/1984 |
| EP | 0494755 | 7/1992 |
| JP | 01175535 | 7/1989 |
| JP | 02267811 | 11/1990 |
| JP | 06187851 | 7/1994 |

* cited by examiner

*Primary Examiner*—Chau N Nguyen
(74) *Attorney, Agent, or Firm*—McGarry Bair PC

(57) ABSTRACT

An electrical composite conductor includes a CuAg alloy base having an Ag content of 0.08 to 0.12% and a CuMg alloy having a Mg content of 0.1 to 0.7%. The composite conductor further includes a conductor edge and a conductor core, wherein at least one of the edge and the core include the CuMg alloy.

10 Claims, 2 Drawing Sheets

COMPOSITE ELECTRICAL CONDUCTOR AND METHOD FOR PRODUCING IT

CROSS REFERENCE TO PRIOR APPLICATIONS

This application is a U.S. National Phase application under 35 U.S.C. §371 of International Application No. PCT/EP2006/012177, filed on Dec. 18, 2006 and claims benefit to German Patent Application No. DE 10 2005 060 809.4, filed on Dec. 20, 2005. The International Application was published in German on Jun. 28, 2007 as WO 2007/071355 under PCT Article 21 (2).

FIELD

The present invention relates to a composite electrical conductor, in particular a trolley wire, and to a method for producing it.

BACKGROUND

Various proposals have been made for improving composite conductors (in particular trolley wires) in terms of the mechanical strength thereof without, however, allowing a decrease in the electrical conductivity to occur. For this purpose, further alloying partners which contribute to a mechanical hardening of the conductive material are added to conductive copper material, and where for instance silver is concerned, the electrical conductivity does not decrease substantially.

Composite conductors and associated production methods are known. For different applications relating to electrical conductivity, correspondingly different configurations have already been proposed. Very specific applications are required in relation to superconductivity. Extrusion equipment has been found to have a wide range of applications in the production of rods, profiles and hollow bodies, known as conform methods, i.e., continuous forming. Older equipment is based on an invention which is described in DE 221169 C2. The method has become especially well known under the name Holton Conform, because it comes from the company Holton, from which for example the application EP 0494 755 A1 originates. The sheathing of elongate material is termed conform cladding. More recent variants of the production technique can be found in EP 0125 788 A2, for example.

SUMMARY

An object of the present invention is to provide the construction of a composite electrical conductor and a method for producing it so as to obtain a conductor with maximum electrical conductivity and the best possible mechanical strength.

In an embodiment, the present invention provides an electrical composite conductor comprising a CuAg alloy base having an Ag content of 0.08 to 0.12% and a conductor edge and a conductor core, at least one of the edge and the core including a CuMg alloy having a Mg content of 0.1 to 0.7%.

BRIEF DESCRIPTION OF THE DRAWINGS

The invention is shown in three figures, in which, in detail.

DETAILED DESCRIPTION

Figure 2:
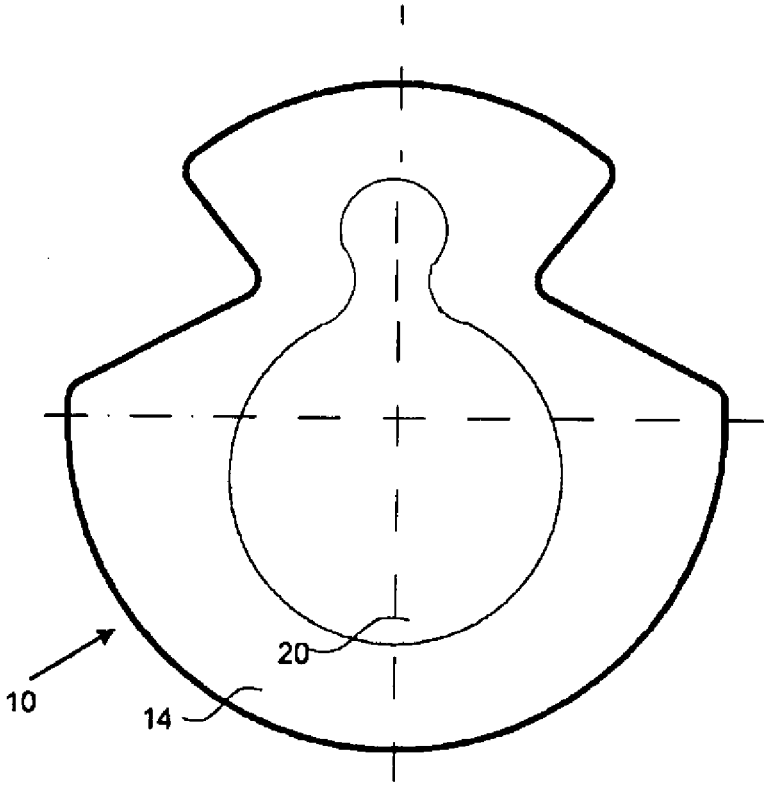
FIG. 2 shows the cross-section of a trolley wire with only one core wire.

The proposed composite conductor surpasses the previously available materials in terms of its mechanical and electrical properties. Simultaneously, it can be widely adapted to meet various requirements. The flexibility of the production process is thus increased and the variety of products is expanded.

The present invention, and thus the composite conductor, consists of a CuAg alloy base having an Ag content of 0.08 to 0.12% and the edge or the core of the composite conductor consists of a CuMg alloy having an Mg content of 0.1 to 0.7%.

Further embodiments consist of the following:

The Mg content of the CuMg alloy is preferably 0.5% Mg. The silver content in the base alloy is preferably 0.1% Ag.

The proportion of the alloy present at the core is between 10 and 80% by area over the cross-section of the composite conductor. The proportion of a CuMg alloy present in the core should preferably be 50% by area.

The construction of the core can comprise a single wire strand or a plurality thereof.

If a plurality of wire strands are present at the core, the wire strands have more or less the same diameter as one another.

The composite conductor can be produced with different cross-sections. Such cross-sections may be: circular for producing a round wire, approximately rectangular for producing a conductor rail, or profiled for a profile wire. Trolley wires should be mentioned as a preferred field of use for a profile wire. In this connection, reference is made to the standard EN 50149, in which trolley wires are standardised.

To produce the composite conductor according to the invention, the known extrusion process is proposed. This involves the production of rods or wires by extrusion. The cladding material is introduced into preferably two peripheral grooves of an extruder wheel, high friction on a counterbearing producing a free-flowing tubular formation which exits the extrusion opening as the cladding of the core material. The core material is inserted through a hollow portal mandrel tangential to the extrusion wheel; the cladding material surrounds the core material. Subsequently, the product is guided through one or more dies and reduced to the final dimensions. As mentioned above, suitable extrusion apparatus is commercially available.

In the present invention, the high hardening capacity and conductivity of CuMg alloys is made use of in combination with the high conductivity, average hardening capacity and good wear properties of CuAg alloys. Thus, the physically limited range of conventional trolley wires, which consist of only one alloy, can be substantially extended with the proposed alloying partners in terms of strength and electrical conductivity. In contrast, in particular, to the previously known composite trolley wires made of steel-clad copper wire, the proposed composite trolley wire is more corrosion-resistant and can more beneficially be recycled, as well as having better electrical conductivity.

A grooved trolley wire, which contains at least one wire made of CuMg 0.1-0.7 in the core and is surrounded by a cladding of CuAg 0.1, may be produced as a trolley wire. The core wire may be round or be more or less fitted to the outer profile of the cladding (grooved profile). The proportion by area of the core wire in the cross-section of the composite conductor can vary within a wide range. The core wire is distinguished in that it can be adjusted to a desired strength by means of various degrees of cold work and is introduced into the composite at this strength. By means of an additional cold work process, applied, for example, by Holton Conform extrusion further hardening of the composite trolley wire takes place. This allows variability in the adjustable product properties, especially the strength and the electrical conductivity. Further, depending on the desired properties of the composite trolley wire, a construction similar to the final profile is possible with reduced drawing costs.

However, it is also possible for the material pairing to be in another form, where at least one wire made of CuAg 0.1 is embedded in the core and the core is surrounded by a cladding made of CuMg 0.1-0.7.

When applying a relatively high degree of cold work by the Holton Conform process, the hardening of the CuAg cladding already lies in the saturation range (thermodynamic equilibrium) and the strength of the cladding as a whole is substantially lower than that of the core, this being advantageous for the laying properties of the trolley wire i.e., low or reduced corrugation after the cable reel is wound. Further, in comparison, the structural homogeneity of the high-strength core wire is much higher than a conventional trolley wire made of a single substance, meaning that comparable mechanical properties can be achieved throughout the length of the trolley wire.

In terms of material properties, it can be estimated for example that with a 25% area of the core wire consisting of CuMg 0.5, a conductivity of 90% IACS (52 MS $m^{-1}$) and a tensile strength of at least 435 $N/mm^2$ will be obtained, and with a 50% area of the core wire consisting of CuMg 0.5%, a conductivity of 81% IACS (47 MS $m^{-1}$) and a tensile strength of 490 $N/mm^2$ will be obtained.

Production Methods

Using conventional production methods, a core wire, round or in the form of a profile wire, with a defined, usually high strength and conductivity is produced from a CuMg alloy, for example CuMg 0.5. The surface of the core wire(s) is carefully freed of foreign or corrosion layers, for example by chemical treatment. In core wires with a foreign-substance-free, activated surface, it is ensured that a good material connection to the cladding substance can be produced. Surface cleaning is important in order that the close material connection between the core wire and the cladding be maintained in the further forming process.

A core wire which has been produced and pre-treated in this manner is clad with the very highly conductive substance CuAg 0.1 in a conform cladding process. During the process, the core wire should preferably be prevented from re-crystallising under the resulting thermal load. The resulting composite wire is brought into the final profile form thereof via further drawing steps and thus further hardened. Depending on the required proportion of the cross-section, the core wire can be introduced as a round wire or profile wire. The production process should be controlled in such a way that no core wires come to lie in the edge or cladding region near the surface of the composite conductor, so that no core wire is present in a cladding region of approximately 10% of the diameter. The reduction in cross-section in the drawing process has an effect on the final strength of the product. In order to produce a trolley wire which is suitable for use in high-speed rails, a relatively large reduction in cross-section is carried out. Trolley wires of this type are assembled with especially high tensile strength so that they yield only slightly to the pressure of a trolley and ensure a high wave propagation rate for this traction. A high degree of mechanical strength is therefore a prerequisite for this application.

As has already been mentioned, composite conductors according to the invention may also be used as conductor rails. Conductor rails are used while stationary in electrical distribution devices, and this means that mechanical strength is of lesser importance in this application.

Figure 1:
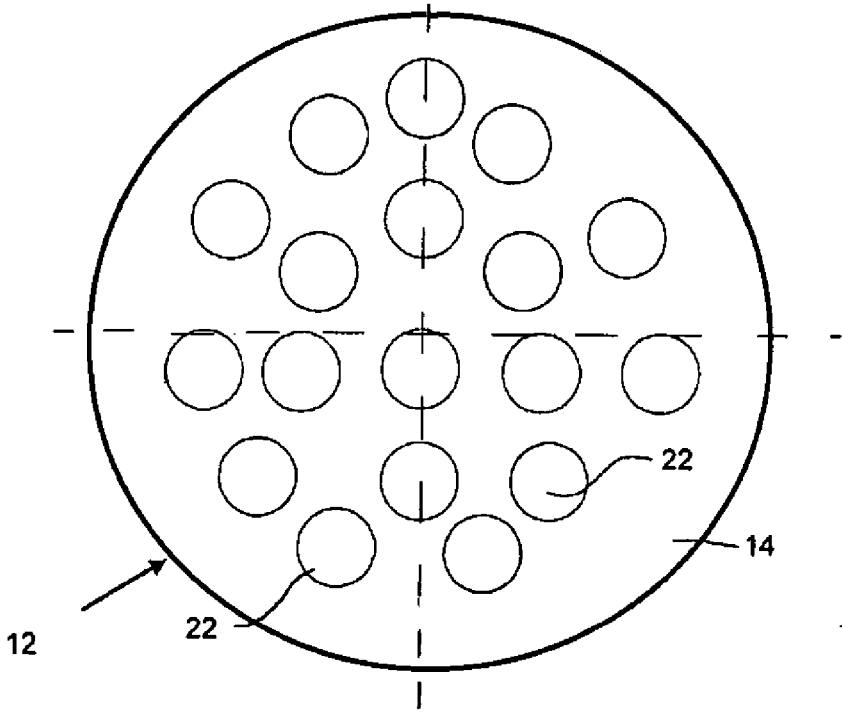
FIG. 1 shows the cross-section of a round wire with a plurality of core wires.

FIG. 1 shows a round wire 12 in which a plurality of core wires 22 lie. The individual wires 22 are distributed irregularly in the material 14 and lie at a distance from the surface of the round wire, in such a way that a core-wire-free edge zone is present. The regularity of the individual wire distribution depends on the production method employed, and may correspondingly be controlled.

FIG. 2 shows a trolley wire 10, specifically a grooved trolley wire in accordance with EN 50149, containing a wire made of CuMg 0.1-0.7 in the core 20 and surrounded by a sheath 14 made of CuAg 0.1. The core wire 20 originates from a round wire which has also been deformed by the profiling, gaining a pear-shaped cross-section. It will immediately be understood that the cross-sectional shape of the core wire will depend on the strength of the deformation and the form of the extruded initial profile, so trolley wires which still have an almost round cross-section may also be produced.

The proportion by area of core wire in the cross-section of the composite conductor can vary within a wide range, for example 10 to 80%. If a CuMg alloy is provided at the core, the proportion of this CuMg alloy should preferably be 50% by area.

Figure 3:
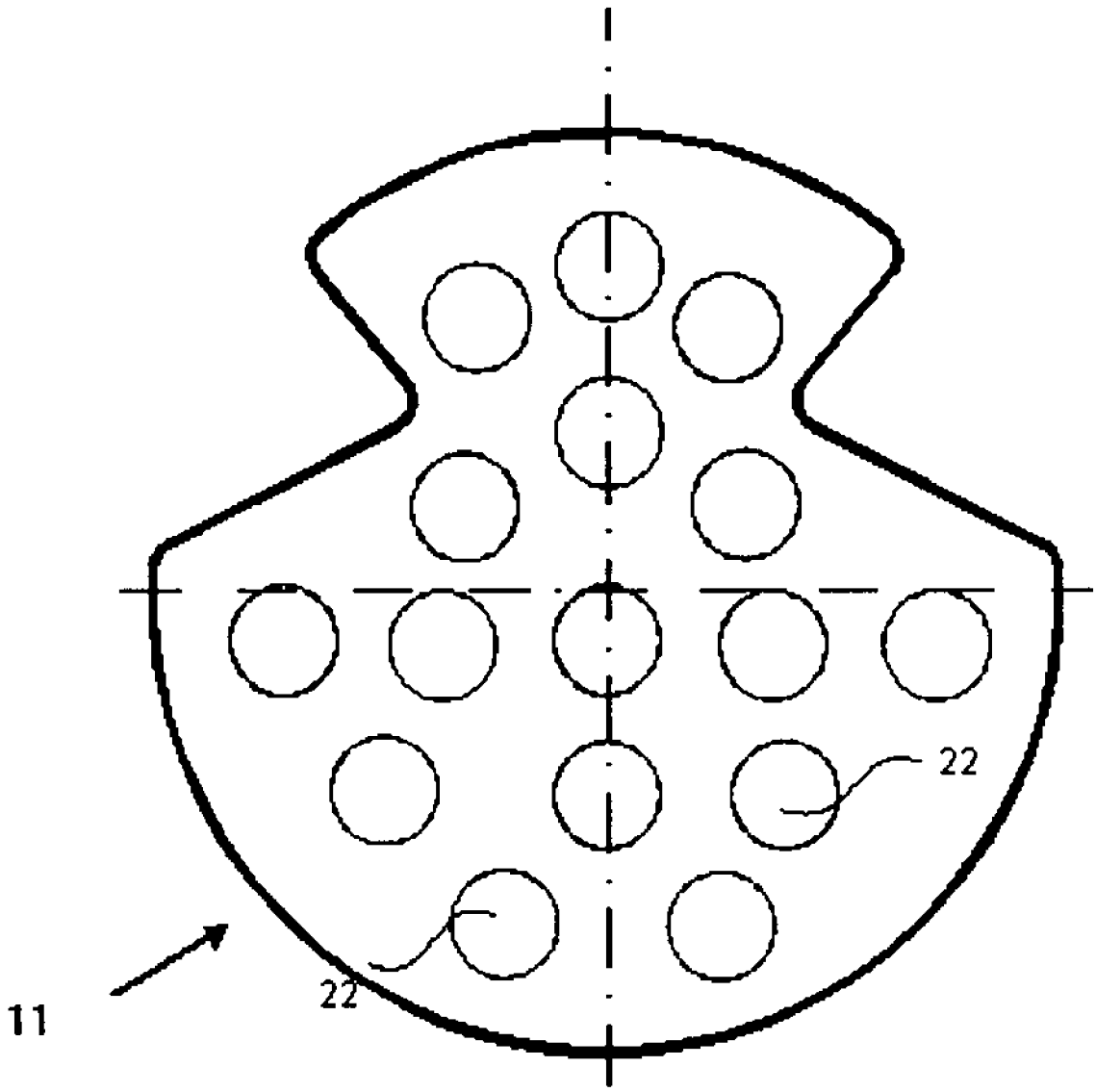
FIG. 3 shows the cross-section of a trolley wire with a plurality of embedded wires.

FIG. 3 shows a trolley wire 11 which comprises, in the core, a plurality of wire strands 22 which are distributed more or less regularly. The wire strands 22 preferably originate from a wire stock with a uniform diameter, so the embedded wire strands also have an approximately uniform diameter, except insofar as they undergo different deformations in the production phase. However, the wire strands may also have a non-round cross-section.

Another numerical example of a trolley wire is as follows: the cross-section of the core wire is 4 $mm^2$. With a proportion of the core wire of 50% by area, about 15 core wires would have to be introduced into a grooved trolley wire, according to the above standard, with a cross-section of about 120 $mm^2$.

The invention claimed is:

1. An electrical composite conductor comprising:

a CuAg alloy base having an Ag content of 0.08 to 0.12%; and, a conductor edge; and a conductor core, wherein at least one of the edge and the core includes a CuMg alloy having a Mg content of 0.1 to 0.7%.

2. The electrical composite conductor as recited in claim 1, wherein a cross-sectional area of the conductor core is between 10 to 80% of a cross-sectional area of the composite conductor.

3. The electrical composite conductor as recited in claim 1, wherein the conductor core includes at least one wire strand.

4. The electrical composite conductor as recited in claim 3, wherein the at least one wire strand includes a plurality of wire strands, each of the plurality of wire strands having an approximately same cross-sectional area.

5. The electrical composite conductor as recited in claim 1, wherein the composite conductor has a round cross-section.

6. The electrical composite conductor as recited in claim 1, wherein the composite conductor includes a grooved wire.

7. The electrical composite conductor as recited in claim 6, wherein the grooved wire is a trolley wire.

8. The electrical composite conductor as recited in claim 1, wherein a cladding region of approximately 10% of a diameter of the composite conductor includes no conductor core disposed therein.

9. A method for producing a composite conductor comprising:

providing a CuAg alloy having an Ag content of 0.08 to 0.12%;

providing a CuMg alloy having a Mg content of 0.1 to 0.7%;

producing at least one wire strand from a first of the CuAg and CuMg alloys;

introducing the at least one wire strand into an extrusion apparatus;

providing the wire strand with a cladding made of a second of the CuAg and CuMg alloys, so as to provide the composite conductor; and pulling the composite conductor through a drawing die at least one time so as to bring the composite conductor into a final profile form.

10. The method for producing a composite conductor as recited in claim 9, further comprising:

freeing a surface of the at least one wire strand of a layer of foreign substances before the providing the wire strand with a cladding.

* * * * *